US005437363A

United States Patent [19]

Gungner

[11] Patent Number: 5,437,363

[45] Date of Patent: Aug. 1, 1995

[54] WRAP-AROUND CARRIER SLEEVE WITH ARTICLE RETAINING MEANS

[75] Inventor: Greg Gungner, Port Coquitlam, Canada

[73] Assignee: Crown Packaging Ltd., Vancouver, Canada

[21] Appl. No.: 250,290

[22] Filed: May 27, 1994

[51] Int. Cl.[6] ..... B65D 5/4805

[52] U.S. Cl. ..... 206/140; 206/157; 206/196

[58] Field of Search ..... 206/139, 140, 156, 157, 206/193, 196, 434, 229, 40

[56] References Cited

U.S. PATENT DOCUMENTS

| | | | |
|---|---|---|---|
| 3,029,999 | 4/1962 | De Paul | 229/40 |
| 3,478,951 | 11/1969 | Graser | 229/40 |
| 3,545,667 | 12/1970 | Vjecsner | 229/35 |
| 3,705,681 | 12/1972 | Rossi et al. | 206/140 X |
| 4,077,095 | 3/1978 | Oliff | 24/204 |
| 4,433,807 | 2/1984 | Ganz | 229/40 |
| 4,498,618 | 2/1985 | Sutherland | 229/40 |
| 4,526,316 | 7/1985 | Sutherland | 229/40 |
| 4,574,997 | 3/1986 | Ikeda | 206/434 X |
| 4,708,284 | 11/1987 | Sutherland et al. | 229/48 |
| 4,773,540 | 9/1988 | Schuster | 206/427 |
| 5,002,225 | 3/1991 | Bienaime | 229/198.2 |
| 5,004,147 | 4/1991 | Bienaime | 206/140 X |
| 5,031,770 | 7/1991 | Chaussadas | 206/157 X |
| 5,080,280 | 1/1992 | Kraus | 229/40 |
| 5,094,347 | 3/1992 | Schuster | 206/434 |
| 5,107,986 | 4/1992 | Cooper | 229/40 X |
| 5,163,607 | 11/1992 | Kuhn et al. | 229/40 |
| 5,328,080 | 7/1994 | Holley, Jr. | 206/140 X |

FOREIGN PATENT DOCUMENTS 1232239 2/1988 Canada .

*Primary Examiner*—Jacob K. Ackun
*Attorney, Agent, or Firm*—Kolisch, Hartwell, Dickinson, McCormack & Heuser

[57] ABSTRACT

A blank for forming a wrap-around carrier sleeve comprising a plurality of panels connected end to end and having first and second end panels that form the bottom of the sleeve. The first end panel includes at least one retainer flap struck from the panel which is joined to the panel along a fold line. The second end panel is configured to overlap the first end panel and includes at least one male supporting tab comprising a neck and at least one shoulder, the male tab being joined to the second end panel at a fold line. The male supporting tab is configured to extend through the opening in the first panel from which the retaining flap is struck and engage with the first panel to support the retaining flap within the carrier sleeve thereby forming a three-dimensional protuberance within the sleeve that serves to limit movement of an article in the sleeve towards an open end of the sleeve.

8 Claims, 8 Drawing Sheets

WRAP-AROUND CARRIER SLEEVE WITH ARTICLE RETAINING MEANS

FIELD OF INVENTION

This invention relates to wrap-around article carriers, and in particular, such article carriers comprising a sleeve having at least partially open ends formed from a blank comprising a plurality of panels which become the top, bottom, and sides of the sleeve.

BACKGROUND OF THE INVENTION

Wrap-around article carriers are used to enclose a plurality of similarity shaped containers such as beverage containers. Typically, such an article carrier comprises a sleeve with at least partially open ends. The sleeve is formed by folding a blank comprising a plurality of panels which become the top, bottom and sides of the sleeve. Usually, such a blank will have a generally rectangular shape with end portions of the blank cooperating to form a continuous sleeve for enclosing articles. The blank is constructed from a material that is suitable for folding while possessing sufficient rigidity and strength for use in an article carrier. Paperboard is a common material used in manufacture of article carrier sleeves.

Article carrier sleeves of the kind described above may be rapidly assembled to enclose articles by using machinery designed to form a sleeve from a blank. Such machinery carries out the steps of folding the blank into a sleeve surrounding the articles and engaging cooperating locking means on the blank to maintain the sleeve in a tensioned state around the articles.

Having at least partially open ends of the sleeve reduces the amount of material required in constructing the article carrier and the number of steps required to form the carrier. However, the absence of material at the ends of the sleeve makes it possible for articles retained within the sleeve to move outwards through the end of the sleeve and possibly be lost, unless some means is provided for limiting such outward movement. Outward movement of articles retained within the sleeve is a particular problem where the articles are not of uniform shape such as where the articles are bottles having a narrow neck portion, a broad middle portion, and a base portion tapering inwards from the middle portion to the bottom of the bottle.

The sleeves described in U.S. Pat. Nos. 5,094,347 and 5,107,986 seek to overcome the above described disadvantages by providing integral article retaining means within the sleeve which are essentially 3-dimensional protuberances formed in the bottom of the sleeve adjacent open ends of the sleeve and positioned to be adjacent to the base of articles retained within the sleeve so as to prevent outward movement of the articles towards the open ends of the sleeve. In each case, the bottom of the sleeve is formed from overlapping end portions or panels of the blank with the outer bottom panel including a retaining flap which is forced through a corresponding opening in the inner bottom panel and is folded within the resulting sleeve to form the 3-dimensional article retaining means. Where it is desired to form embodiments of these inventions on automatic packaging machinery, such machinery must include a movable punch or rod element that forces the retaining flap through the corresponding opening in the inner bottom panel.

Another example of an article retaining sleeve that requires the use of a movable punch or rod element to form a three-dimensional protuberance within the sleeve to act as a retaining means is that described in copending U.S. patent application Ser. No. 08/020,752 of Gungner and Zimmerman. The process of forming the sleeves described in U.S. application Ser. No. 08/020,752 and U.S. Pat. Nos. 5,094,347 and 5,107,986, as well as the machinery required for doing so, is more complex than is required in forming other sleeves known in the art that lack such three-dimensional protuberances as retaining means. Examples of sleeves of the latter type are those provided under the trademark JAK-ET-PAK as well as the sleeve of Sutherland et al described in U.S. Pat. No. 4,708,284, wherein a male locking tab of the blank is on an outer overlapping bottom panel of the sleeve. In automated packaging machinery, the male locking tab is first folded and then is pushed by means of a ramp over which the blank travels, through a corresponding opening (such as a slit) in an inner overlapping bottom panel of the sleeve so that the male tab extends within the sleeve and is engaged therein. The male tab serves as a secondary locking element and the tab may be positioned within the sleeve so as to separate adjacent articles held within the sleeve. The kind of automated packaging machinery used to form such sleeves does not require a punch or rod element to push the male locking tab through the corresponding opening.

BRIEF SUMMARY OF THE INVENTION

This invention provides a blank for forming a wrap-around carrier sleeve comprising a plurality of panels connected end to end including first and second end panels at opposite ends of the blank configured to overlap and cooperate to form a bottom of the sleeve. The first end panel will be the inner bottom panel of the sleeve and includes at least one retainer flap struck from the panel whereby an opening in the panel corresponding to the retainer flap is formed. The retainer flap is joined to the first panel along a fold line. The second end panel will be the outer bottom panel of the sleeve and includes at least one male supporting tab having a neck by which the tab is connected to the second panel. The supporting tab has at least one shoulder extending away from the neck. The supporting tab is located so that when the second panel overlaps the first panel, the supporting tab may extend through the opening in the first panel from which the retainer flap is struck, with the shoulder of the tab engaged with the first panel adjacent the opening, whereby the tab supports the retainer flap. The retainer flap supported on the male supporting tab forms a three-dimensional protuberance within the sleeve that serves to limit movement of an article adjacent the flap in the sleeve towards an open end of the sleeve.

This invention also provides a carrier sleeve formed from the aforementioned blank of this invention.

In a preferred form of the invention, retaining flaps are provided on opposite side portions of the first panel to form retaining means protuberances adjacent the two ends of the sleeve. Corresponding male supporting tabs are provided on opposite side portions of the end of the second panel. Each of the retaining flaps is connected to the first panel at a fold line extending generally parallel to an adjacent side of the first panel. Preferably, each retaining flap will have at least one secondary fold line extending from a side of the retainer flap not connected to the first panel which permits the retainer flap to be folded on or over the male supporting tab thereby providing additional facets on the three-dimensional protuberance. Most preferably, the retaining flap will be provided with two curved secondary fold lines, each having a configuration generally corresponding to the configuration of the outer surface of an adjacent article, whereby the shape of the facets formed when the retaining flap is folded at the secondary fold line means will complement the outer surfaces of adjacent articles.

It is preferable that the male supporting tab be of the kind described as the secondary locking tab in U.S. Pat. No. 4,708,284. Such a tab comprises a narrow neck connected to the end of an end panel of the blank at a fold line. The tab will preferably have shoulders extending from opposite sides of the neck.

It is also preferable that a carrier sleeve of this invention be provided with primary locking means such as the primary male and female locking elements shown in U.S. Pat. No. 4,708,284, although a variety of such locking means are well known in the art and may be employed in this invention.

The male supporting tab of this invention will be configured to engage with the first panel when the tab extends through the opening in the first panel from which the retaining flap is struck. A variety of means for such engagement are well known in the art and may be employed in this invention. For example, the shoulder of the male supporting tab may be configured to overlie a portion of the first panel on the interior of the sleeve adjacent the opening. The portion of the first panel adjacent the opening on which the shoulder of the male tab is to engage may comprise a small tab connected to the first panel which does not form part of the retaining flap. The small tab may be configured to deflect permitting passage of the shoulder of the male tab, and to then return to engage with the shoulder of the male tab thereby preventing the tab from being pulled from the opening. In addition, one or more slits may be provided in the first panel adjacent the opening that are configured to cooperate with a shoulder or shoulders of the male locking tab to facilitate passage of the male support tab through the opening in the first panel and then engagement of the shoulders of the male tab on the first panel. A variety of configurations of such slits are well known in the art and may be employed in this invention.

The nature of the invention is more particularly described by reference to the following detailed description of a preferred embodiment of the invention and the accompanying drawings.

DETAILED DESCRIPTION

Figure 1:
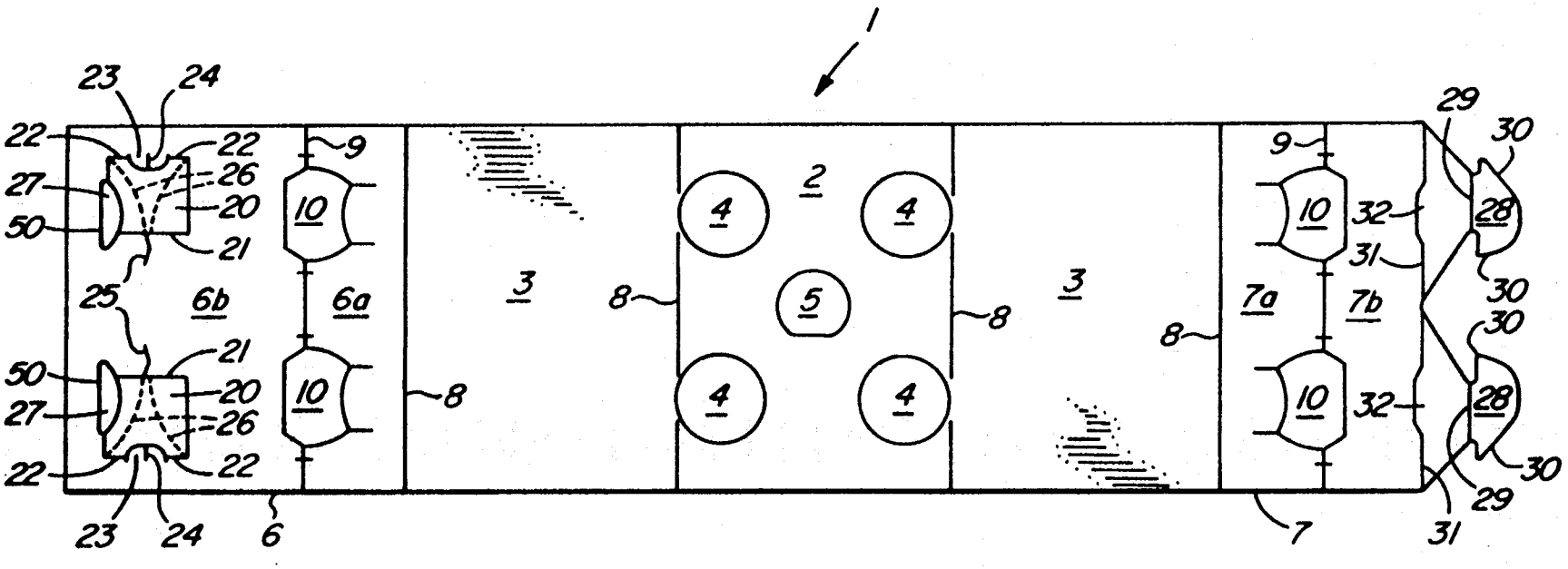
FIG. 1: is a plan view of a flat blank for forming a carrier sleeve.

Referring to FIG. 1, a blank 1 of this invention comprises a substantially rectangular sheet of paperboard or other suitable material. The blank comprises a plurality of panels connected end to end, including a middle panel 2 that will form the top of the wrap-around article carrier sleeve and side panels 3 that will form sides of the sleeve. Top panel 2 may be provided with through-holes or cut-away portions 4 for receiving the top portion of articles to be enclosed by the sleeve and a handle 5 which in this embodiment is a through-hole. The blank 1 also comprises first end panel 6 and second end panel 7 located at opposite ends of the blank. End panels 6 and 7 are connected to side panels 3 at fold lines which in this embodiment are creases 8. Likewise, side panels 3 are connected to top panel 2 at creases 8.

In the exemplified embodiment, each of end panels 6 and 7 have fold line means for defining the bottom edges of the sides of the sleeve which in this embodiment are creases 9. Situated along creases 9 are cut-away portions 10 that provide clearance for the bottom of articles to be enclosed within the sleeve. Creases 9 separate the parts 6*a* and 7*a* of the end panels that will form the bottom portion of the sides of the sleeve from the bottom panels 6b and 7b that will form the bottom of the sleeve.

Inner bottom panel 6b in the first end panel 6 has retaining flaps 20 struck from the bottom panel thereby defining the edges of openings 21. Retaining flaps 20 are attached to bottom panel 6b by fold lines which in this embodiment are creases 22 adjacent to and generally parallel with the sides of bottom panel 6b. Small tabs 23 are struck from the retaining flaps 20 thereby remaining an integral part of bottom 6b. Each of small tabs 23 has a slit 24. Opposite small tabs 23 are slits 25 cut into bottom panel 6b and extending from the edge of openings 21. Formed in retaining flaps 20 are secondary fold lines, which in this embodiment are curved creases 26 extending from an edge of the retaining flap opposite crease 22. Adjacent retaining flaps 20 are cut-away portions 27 which are the primary female locking elements for the sleeve.

At the end of bottom panel 7b are two male supporting tabs 28 connected to bottom panel 7b by narrow necks in which there are fold lines which, in this embodiment, are creases 29. Extending to the sides of each neck of tabs 28 are shoulders 30. Adjacent tabs 28 is a fold line extending across panel 7b which in this embodiment is crease 31. Interrupting crease 31 at opposite sides of panel 7b are primary male locking elements 32 struck from the panel.

Figure 2:
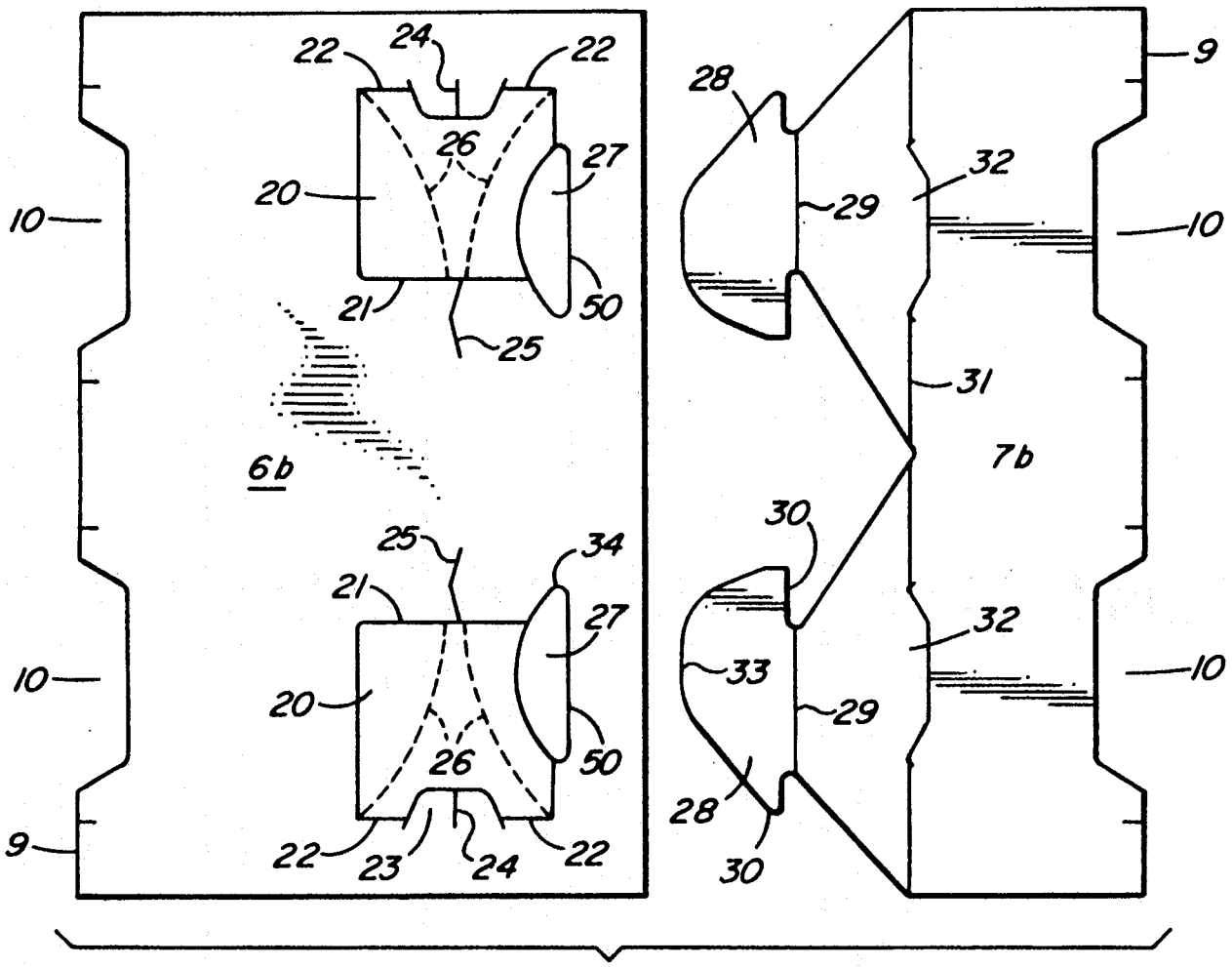
FIG. 2: is an enlarged plan view of first and second end panels of the blank shown in FIG. 1, which form the inner and outer bottom panels of the sleeve respectively, just prior to being positioned in a overlapped condition.

Referring to FIG. 2, wherein like reference numerals to those in FIG. 1 denote like elements of blank 1, inner bottom panel 6b and outer bottom panel 7b are shown at a stage in forming the sleeve, wherein the bottom panels are about to be overlapped. As panel 7b is brought to overlie panel 6b as seen from the exterior of the sleeve, male supporting tabs 28 align with retaining flaps 20 and primary male locking elements 32 align with primary female locking elements 27. Leading edge 33 of male supporting tabs 28 is intended to engage with the bottom of retaining flaps 20 between creases 26 to support the retaining flaps within the sleeve. Shoulders 30 of male supporting tabs 28 will engage with panel 6b on the inside of the bottom of the sleeve. Slits 24 and 25 facilitate the passage of shoulders 30 through bottom panel 6b.

Figure 3:
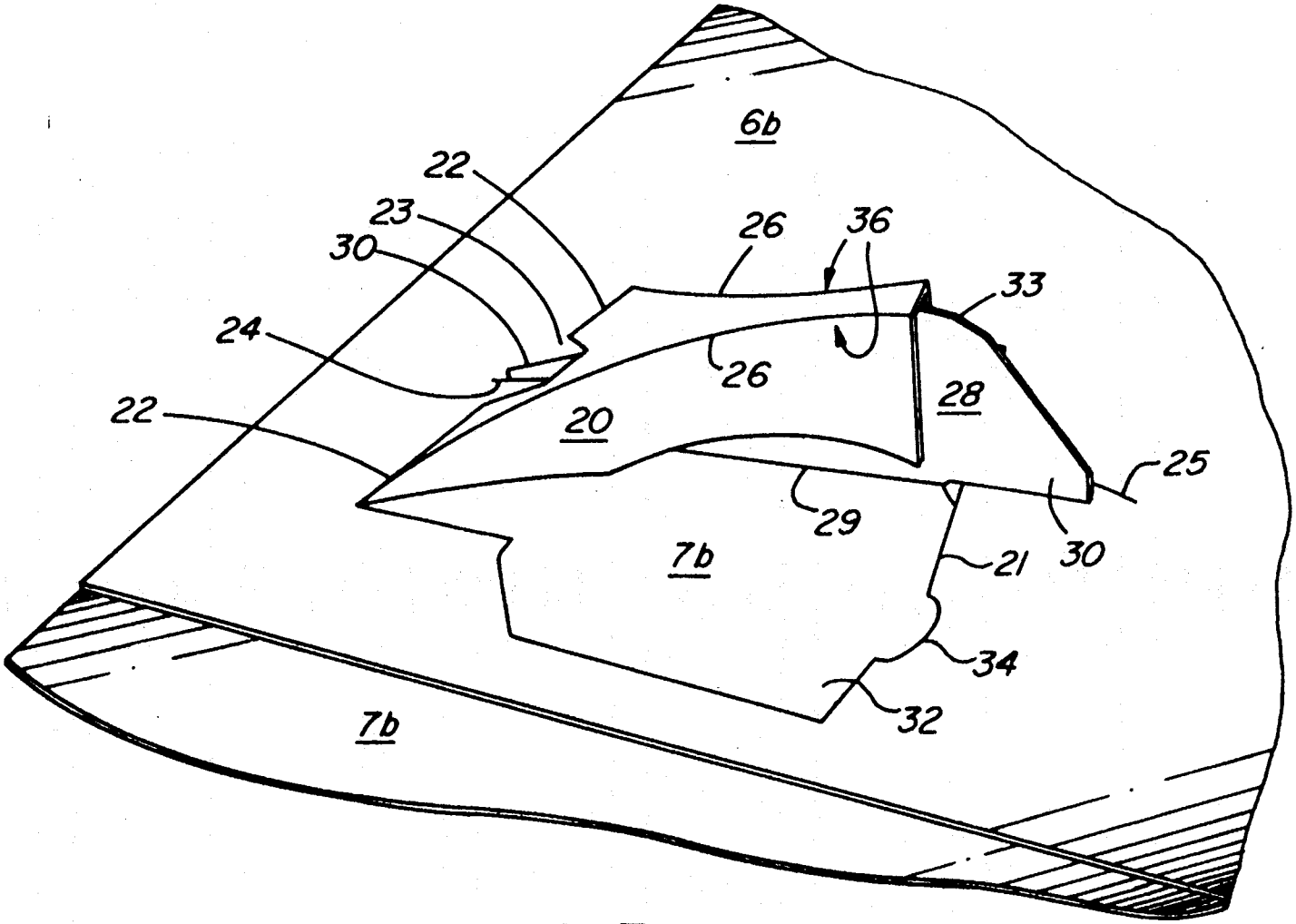
FIG. 3: is a partial perspective view of the interior surface of the bottom of the carrier sleeve showing a preferred form of retaining means comprising a retainer flap folded over a male supporting tab.

Referring to FIG. 3, wherein like reference numerals to those used in the preceding figures denote like elements, inner bottom panel 6b is shown overlying outer bottom panel 7b as seen from the interior of the sleeve. A retaining element of this invention comprising a three-dimensional protuberance within the sleeve has been formed by means of male supporting tab 28, which is folded at crease 29, extending within the sleeve and supporting retaining flap 20. Retaining flap 20 is folded over the leading edge 33 of supporting tab 28 at curved creases 26 thereby forming curved facets 36 configured to engage with bottom portions of two curved articles (not illustrated) that are retained within the sleeve. A portion of panel 7b is seen through opening in panel 6b from which retaining flap 20 was struck. The portion of opening 21 behind supporting tab 28 and not visible in this figure will be an opening through the bottom of the sleeve. Shoulders 30 of supporting tab engage with small tab 23 and a surface of panel 6b opposite the small tab, respectively. Slits 24 and 25 that facilitated the insertion of shoulders 30 through bottom panel 6b are shown adjacent shoulders 30. While engagement of supporting tab 28 in bottom panel 6b provides some locking of panel 7b relative to panel 6b, the primary locking means is provided by the engagement of primary male locking element 32 of panel 7b with the cut-away that is female locking element 27 of panel 6b shown in FIG. 2, the edge of said female element being identified by reference 34 in FIG. 3.

Figure 4B:
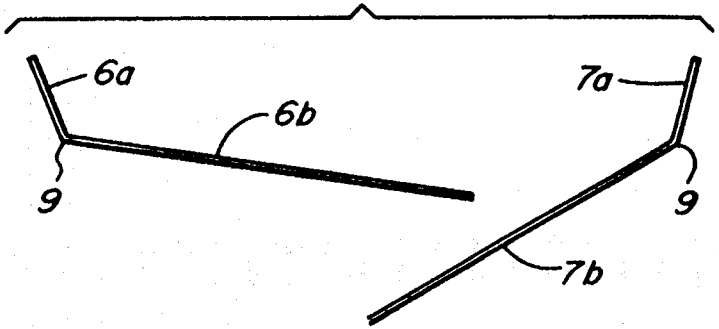
FIG. 4*b*: is a partial end view of the bottom portion of the sleeve shown in FIG. 4*a* showing the partially overlapped end panels of the blank.
Figure 4A:
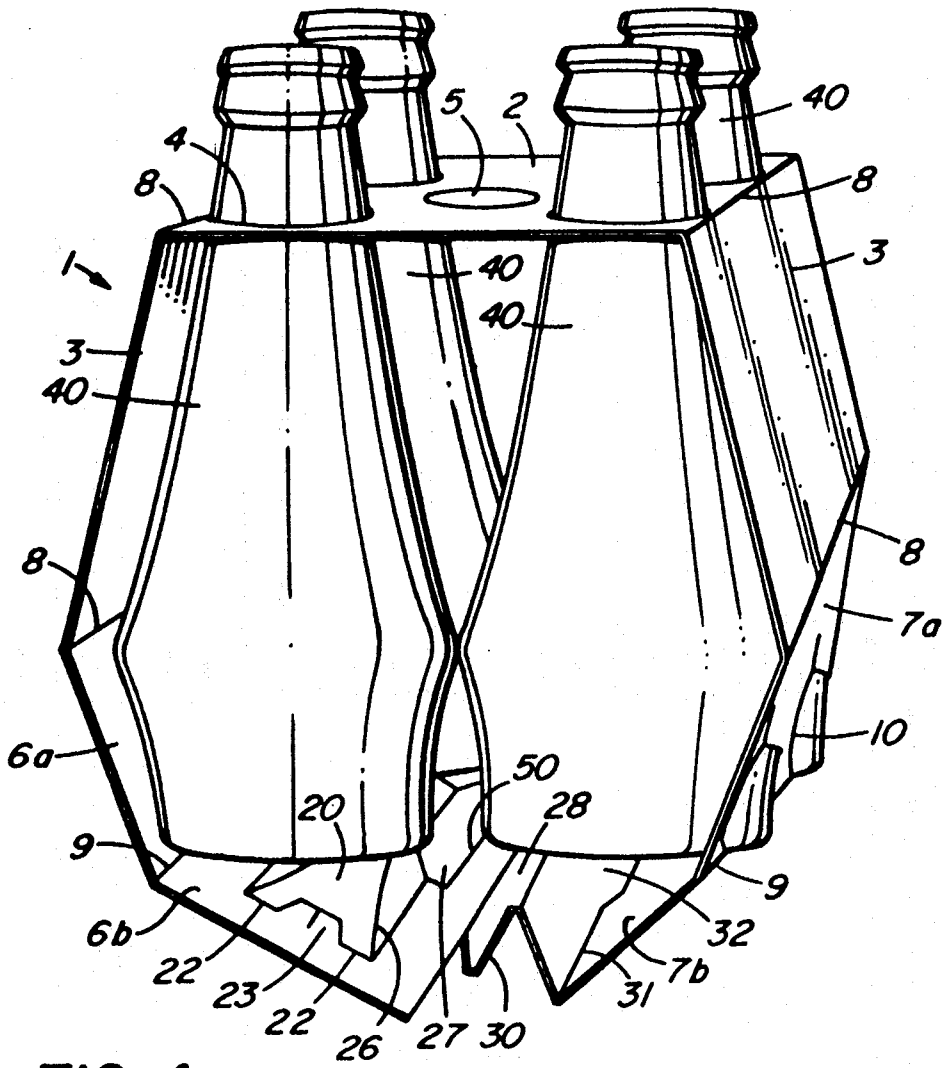
FIG. 4*a*: is a perspective view of a folded blank partially forming a sleeve enclosing four beverage bottles at a stage where first and second end panels of the blank are overlapped to form the bottom of the sleeve.

Referring to FIGS. 4a and 4b, wherein like reference numerals to those used in the preceding figures denote like elements, blank 1 has been folded about four beverage bottles 40. Each of the beverage bottles has a cylindrical profile in end view. Each bottle has a broad middle portion tapering inwards towards the base of the bottle. Cut-away portion 10 accommodates a portion of the curved base of a bottle retained within the sleeve. As is shown in FIG. 4b, at this stage of forming of the sleeve, outer bottom panel 7b is beginning to overlap inner bottom panel 6b, which are both folded at creases 9.

Figure 5B:
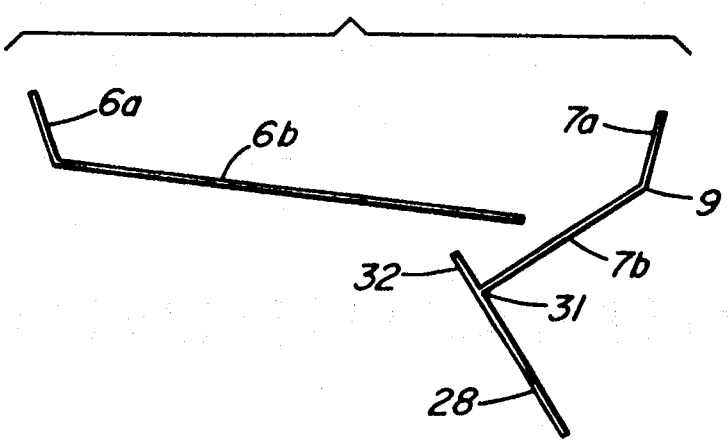
FIG. 5*b*: is a partial end view of the bottom portion of the sleeve shown in FIG. 5*a* showing the end panels of the blank.
Figure 5A:
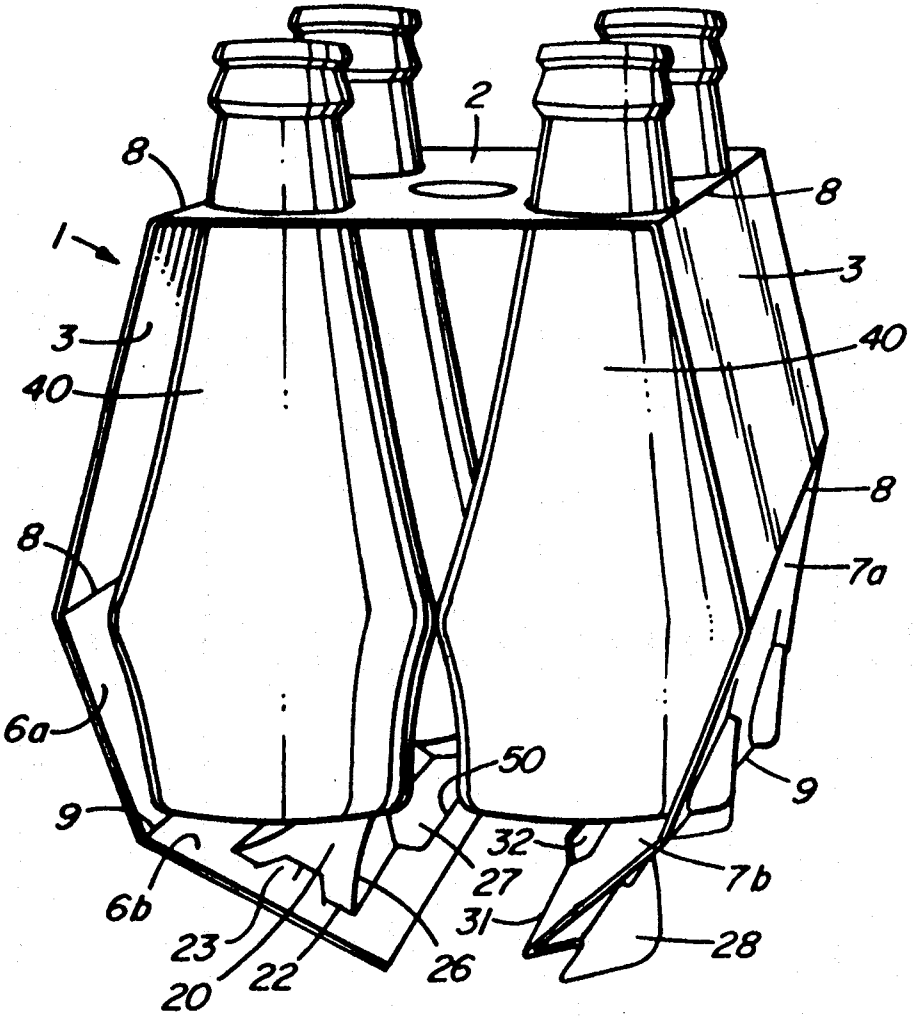
FIG. 5*a*: is a perspective view of the sleeve and articles shown in FIG. 4*a* at a later stage in the sleeve forming process where a portion of the second end panel of the blank has been folded to extend a primary male locking element towards the first end panel of the blank.

In FIGS. 5a and 5b, like reference numerals to those in the preceding figures denote like elements. At this stage, outer bottom panel 7b has been folded at crease 31 so that male supporting tabs 28 extend away from the bottom of the sleeve and primary male locking elements 32 extend towards the bottom of the sleeve.

Figure 6B:
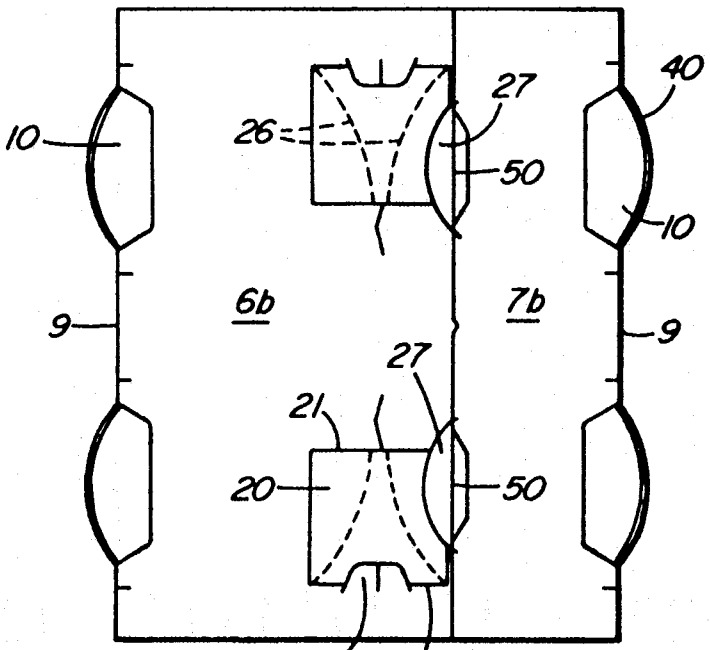
FIG. 6*b*: is an exterior bottom view of the sleeve shown in FIG. 6*a*.
Figure 6C:
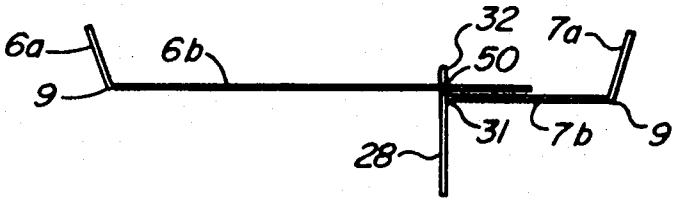
FIG. 6*c*: is a partial end view of the bottom portion of the sleeve shown in FIG. 6*a* showing the overlapped end panels forming the bottom of the sleeve.
Figure 6A:
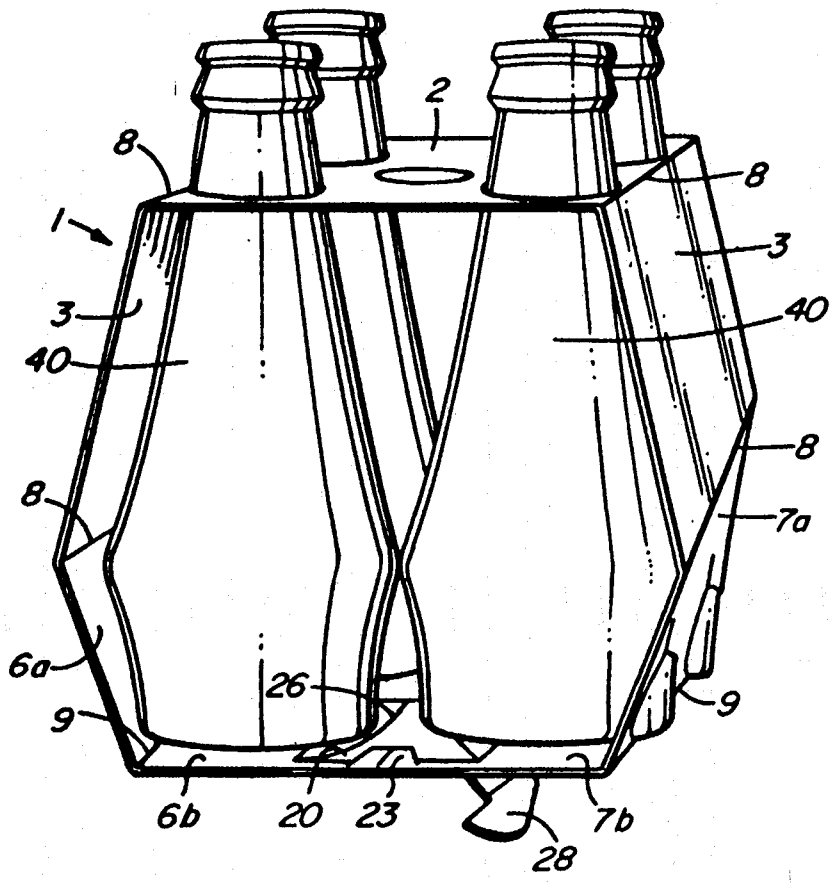
FIG. 6*a*: is a perspective view of the sleeve and articles shown in FIG. 5*a* wherein the end panels of the blank have been fully overlapped and the primary male locking element of the second end panel has been engaged with the first end panel to retain the sleeve under tension around the articles.

In FIGS. 6a, 6b, and 6c, wherein like reference numerals to those shown in the preceding figures denote like elements, a further stage in forming the sleeve is shown. At this point, bottom panel 7b has overlapped panel 6b and primary male locking elements 32 have been inserted into primary female locking elements 27. Male supporting tabs 28 extend away from the bottom of the sleeve. As is shown in FIGS. 6b and 6c, each primary male locking element 32 engages with leading edge 50 of primary female locking elements 27.

Figure 7B:
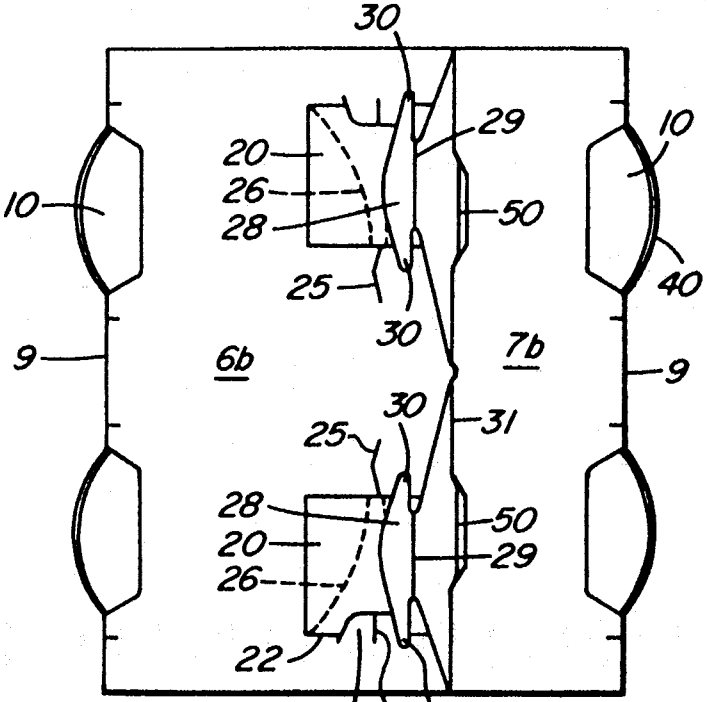
FIG. 7*b*: is an exterior bottom view of the sleeve of FIG. 7*a*.
Figure 7C:
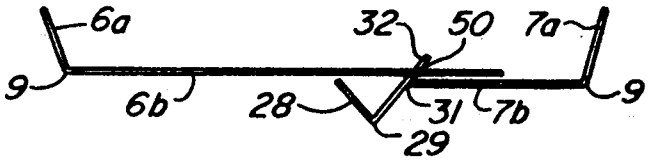
FIG. 7*c*: is a partial end view of the bottom portion of the sleeve of FIG. 7*a* showing the end panels forming the bottom of the sleeve.
Figure 7A:
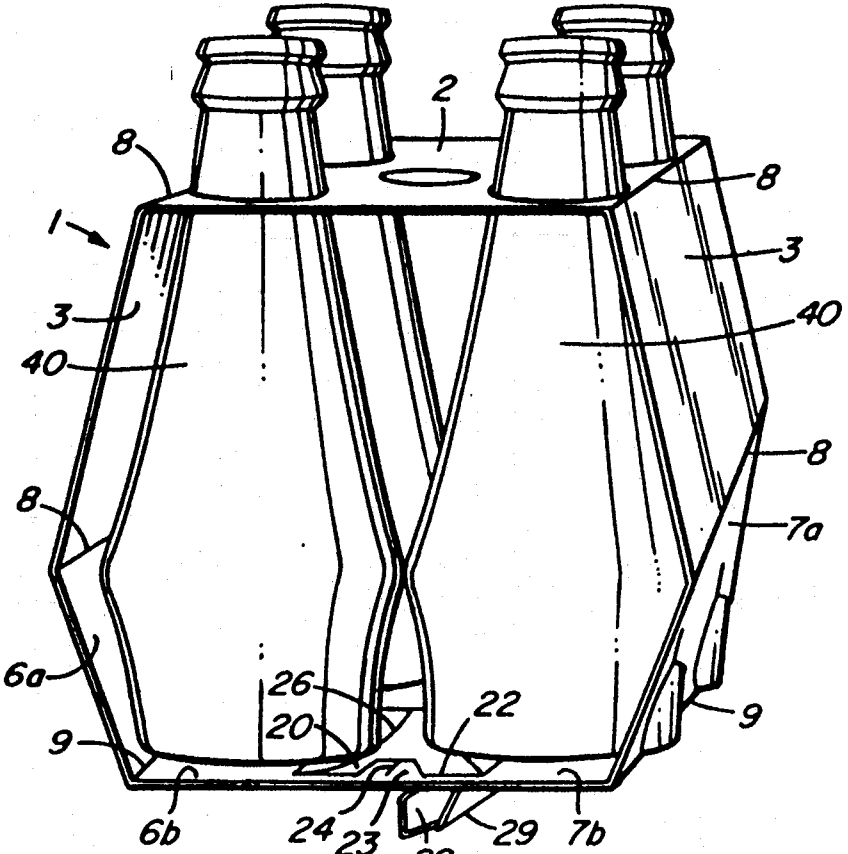
FIG. 7*a*: is a perspective view of the sleeve shown in FIG. 6*a* wherein male supporting tabs on the second end panel of the blank have been folded towards the bottom of the sleeve just prior to insertion of the male support tabs into openings in the first end panel to support retaining flaps.

Referring to FIGS. 7a, 7b, and 7c, wherein like reference numerals to those used in the preceding figures denote like elements, a further stage in the forming of the carrier sleeve is shown. At this point, male supporting tabs 28 are folded towards the bottom of the sleeve at creases 29 and are directed towards the region of slits 24 and 25 adjacent retaining flaps 20. As this is done, the portion of bottom panel 7b to which the neck of male supporting tabs 28 is attached moves upwards towards the bottom of the sleeve, pivoting at crease 31, thereby returning male locking elements 32 towards their original position struck from bottom panel 7b. This action provides the principal means for locking engagement of bottom panels 6b and 7b.

Figure 8B:
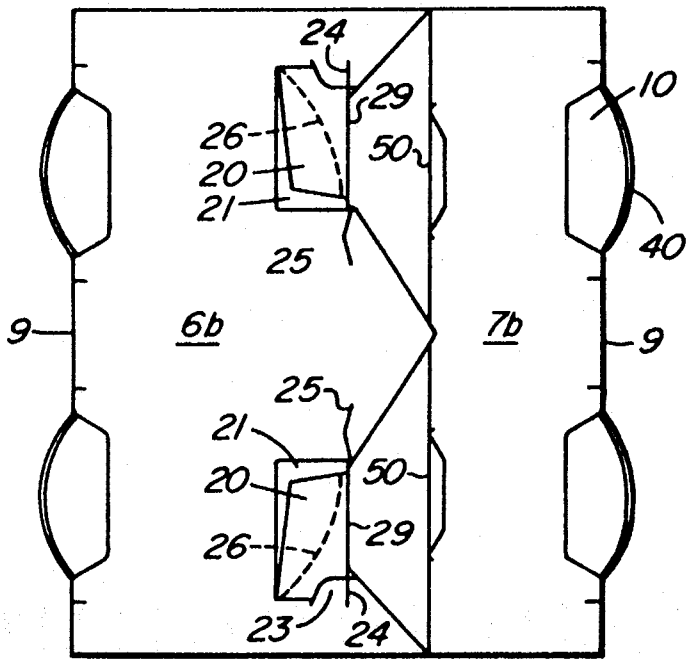
FIG. 8*b*: is an exterior bottom view of the sleeve shown in FIG. 8*a*.
Figure 8C:
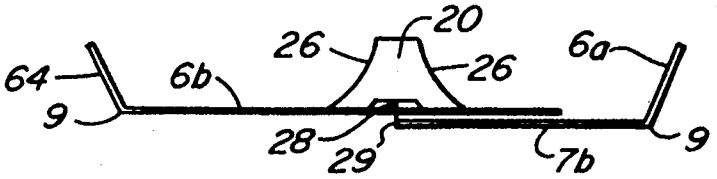
FIG. 8*c*: is a partial end view of the bottom portion of the sleeve shown in FIG. 8*a* showing the end panels forming the bottom of the sleeve.
Figure 8A:
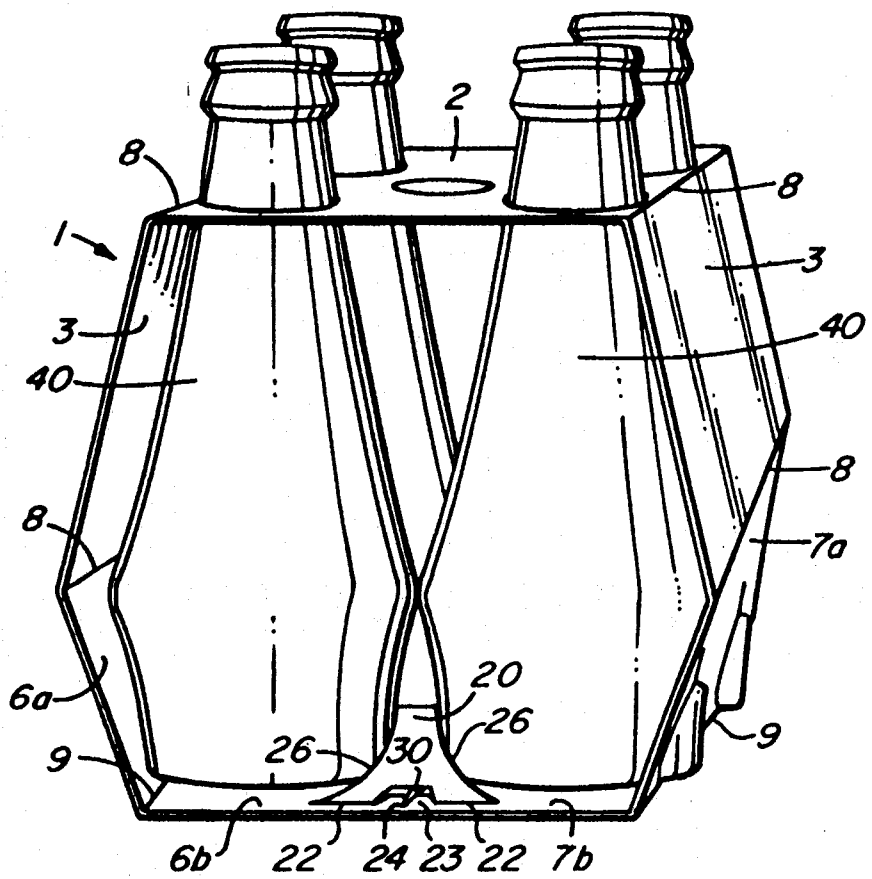
FIG. 8*a*: is a perspective view of the sleeve shown in FIG. 7*a* after the male support tabs have been inserted into the openings of the first panel to support corresponding retaining flaps within the interior of the sleeve as shown in FIG. 3.

In FIGS. 8a, 8b, and 8c, wherein like reference numerals to those used in the preceding figures denote like elements, a fully formed carrier sleeve of this invention is illustrated. At this stage, male supporting tabs 28 have been inserted through openings 21 and slits 24 and 25 in bottom panel 6b. In doing so, male supporting tabs 28 have pushed retaining flaps 20 to the inside of the sleeve. Once shoulders 30 of each male supporting tab 28 have engaged with panel 6b on the inside of the sleeve, retaining flaps 20 are retained and supported within the sleeve thereby forming three-dimensional protuberances that act as retaining means for bottles 40. Curved secondary creases 26 are configured so that when retaining flaps 20 are pushed into the sleeve, the placement of bottles 40 cause the retaining flaps to fold along the curved creases 26. In this way, the curved facets 36 shown in FIG. 3 will be formed adjacent the curved base of each bottle 40.

Formation of the carrier sleeve as illustrated in the preceding figures may be carried out on machinery for forming folding carton wraps with a "lock-bottom"

such as are provided under the trademark JAK-ET-PAK and the carrier sleeve described in U.S. Pat. No. 4,708,284. Such machinery is designed to fold a male tab similar to that shown in the figures as male supporting tab 28 and direct such a tab through corresponding openings or slits in a sleeve panel without the need for separate movable punches or rod elements in the machinery. Thus, this invention provides the means for forming a carrier wrap sleeve having a three-dimensional protuberance as retaining means within the sleeve through the action of placement of a male tab rather than through the action of a machine element forcing a retaining flap through an opening. In this invention, the male supporting tab itself acts as the means for placement of a retainer flap inside the sleeve.

This invention is not limited to the details described herein and changes to the preferred embodiments which do not alter the basic function and concept of the invention may be made without departing from the spirit and scope of the invention, as defined in the appended claims.

I claim:

1. A blank for forming a wrap-around article carrier sleeve comprising a plurality of panels connected end-to-end including first and second end panels at opposite ends of the blank that cooperate to form a bottom of the carrier sleeve, wherein the first end panel includes at least on retaining flap struck from the panel thereby defining an opening in the panel, the retaining flap being joined to the first end panel at a fold line, and wherein the second end panel is configured to overlap the first end panel outside the bottom of the carrier sleeve and includes at least one male supporting tab comprising a neck and at least one shoulder extending to the side of the neck, the neck being joined to the second end panel at a fold line; and wherein said male supporting tab is configured to extend through the opening in the first panel from which the retaining flap is struck, the shoulder of the male tab being configured to engage with the first panel adjacent the opening whereby the male supporting tab supports the retaining flap within the carrier sleeve; and wherein the retaining flap has at least one secondary fold line extending from a portion of the retaining flap not connected to the first panel for facilitating folding of the retaining flap on the male supporting tab.

2. The blank of claim 1, further comprising male and female primary locking elements for locking engagement of the first and second panels in a carrier sleeve.

3. The blank of claim 1, having two male supporting tabs adjacent opposite sides of the second panel and two retaining flaps adjacent opposite sides of the first panel.

4. The blank of claim 3, wherein each retaining flap has two secondary fold lines extending from a portion of each flap not connected to the first panel.

5. The blank of claim 4, wherein each secondary fold line is curved.

6. The blank of claim 3, wherein each male supporting tab has two shoulders and each shoulder extends from opposite sides of the neck of the male supporting tab.

7. The blank of claim 6, wherein adjacent opposite sides of each opening in the first end panel are slits configured to cooperate with shoulders of a male supporting tab.

8. A carrier sleeve formed from the blank of claim 1.

* * * * *